US007710341B2

(12) United States Patent
Kubo et al.

(10) Patent No.: US 7,710,341 B2
(45) Date of Patent: May 4, 2010

(54) PORTABLE ELECTRONIC DEVICE

(75) Inventors: Hiroyuki Kubo, Kusatsu (JP); Hiromitsu Ito, Hakusa (JP); Kuniaki Yosui, Kanazawa (JP); Eiichi Kobayashi, Takatsuki (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 11/769,192

(22) Filed: Jun. 27, 2007

(65) Prior Publication Data

US 2007/0247387 A1 Oct. 25, 2007

Related U.S. Application Data

(63) Continuation of application No. PCT/JP2006/325154, filed on Dec. 18, 2006.

(30) Foreign Application Priority Data

Mar. 13, 2006 (JP) ..... 2006-067800
Jul. 7, 2006 (JP) ..... 2006-187485
Nov. 6, 2006 (JP) ..... 2006-300464

(51) Int. Cl.
*H01Q 7/08* (2006.01)
*H01Q 1/24* (2006.01)
*H01Q 1/36* (2006.01)
*G08B 13/14* (2006.01)

(52) U.S. Cl. ..... 343/788; 343/702; 343/895; 340/572.7

(58) Field of Classification Search ..... 343/787, 343/788, 866, 895; 340/572.1, 572.2, 572.3, 340/572.4, 572.5, 572.6, 572.7, 572.8, 572.9
See application file for complete search history.

(56) References Cited

U.S. PATENT DOCUMENTS 5,923,300 A * 7/1999 Mejia ..... 343/788
6,163,305 A * 12/2000 Murakami et al. ..... 343/788
6,229,444 B1 * 5/2001 Endo et al. ..... 340/572.6
6,927,738 B2 * 8/2005 Senba et al. ..... 343/787

(Continued)

FOREIGN PATENT DOCUMENTS

JP 10-242742 * 9/1998

(Continued)

OTHER PUBLICATIONS

PCT/JP2006/325154, Written Opinion dated Feb. 27, 2007 (with English translation).*
PCT/JP2006/325154, International Search Report.*

*Primary Examiner*—Hoang V Nguyen
*Assistant Examiner*—Robert Karacsony
(74) *Attorney, Agent, or Firm*—Dickstein Shapiro LLP

(57) ABSTRACT

A portable electronic device includes a circuit board and an antenna coil installed on the circuit board. The antenna coil includes a magnetic core and a coil wound at either side of an unwound portion. The winding direction of the coil is changed at either side of the unwound portion. When the length of the magnetic core is defined as X and the distance between two intersecting points at which a virtual line formed by projecting the central line of the magnetic core onto the circuit board intersects the outer periphery of the circuit board is defined as Y, the antenna coil satisfies Y≧X≧0.8Y.

12 Claims, 10 Drawing Sheets

U.S. PATENT DOCUMENTS

| | | | | |
|---|---|---|---|---|
| 7,209,090 | B2 * | 4/2007 | Hall et al. | 343/788 |
| 7,280,076 | B2 * | 10/2007 | Ninomiya et al. | 343/702 |
| 7,317,426 | B2 * | 1/2008 | Copeland et al. | 343/788 |
| 2003/0226892 | A1 * | 12/2003 | Arimura | 235/439 |
| 2004/0140896 | A1 * | 7/2004 | Ohkawa et al. | 340/572.1 |
| 2005/0162331 | A1 * | 7/2005 | Endo et al. | 343/788 |

FOREIGN PATENT DOCUMENTS

| | | | |
|---|---|---|---|
| JP | 11-122146 | * | 4/1999 |
| JP | 2003-016409 | * | 1/2003 |
| JP | 2003-318634 | * | 7/2003 |
| JP | 2003-298348 | * | 10/2003 |
| JP | 2004-187159 | * | 7/2004 |
| JP | 2004-229144 | * | 8/2004 |
| JP | 2005-192124 | * | 7/2005 |
| JP | 2005-333244 | * | 12/2005 |
| JP | 3121577 | * | 4/2006 |
| JP | 2005-277524 | * | 10/2006 |
| WO | WO 98/44586 | * | 10/1998 |

* cited by examiner (A)

(B)

(A)

(B)

(A)

(B)

PORTABLE ELECTRONIC DEVICE

CROSS REFERENCE TO RELATED APPLICATIONS

The present application is a continuation of International Application No. PCT/JP2006/325154, filed Dec. 18, 2006, which claims priority to Japanese Patent Application No. JP2006-067800, filed Mar. 13, 2006, Japanese Patent Application No. JP2006-187485, filed Jul. 7, 2006, and Japanese Patent Application No. JP2006-300464, filed Nov. 6, 2006, the entire contents of each of these applications being incorporated herein by reference in their entirety.

FIELD OF THE INVENTION

The present invention relates to portable electronic devices for, for example, portable telephone terminals having wireless tags for RFID (Radio Frequency Identification) used for communication with external devices via electromagnetic-field signals.

BACKGROUND OF THE INVENTION

Portable electronic devices such as cellular phones having RFID wireless tags have come into widespread use in recent years, and some of which include antenna coils for wireless tags as described in, for example, Patent Document 1. FIG. 17 is a perspective view illustrating the principal part of a portable electronic device 800 shown in Patent Document 1. FIG. 17 illustrates the structure of the portable electronic device 800 including a substrate 500 and a cylindrical antenna coil 600 having a magnetic core 601 disposed on the substrate 500. The antenna coil 600 is disposed such that the axial direction thereof is parallel to the surface of the substrate 500, and can be interlinked with a magnetic flux parallel to the surface of the substrate 500.

Moreover, Patent Document 2 shown in FIG. 18 discloses a portable electronic device 810 capable of being interlinked with a magnetic flux parallel to the surface of a substrate 510 in all directions by disposing an antenna coil 610 including an L-shaped magnetic core 611 formed of a first leg portion 611*a* and a second leg portion 611*b* on the substrate 510.

Patent Document 1: Japanese Unexamined Patent Application Publication No. 2003-16409

Patent Document 2: Japanese Unexamined Patent Application Publication No. 10-242742

FIG. 19 is a schematic view illustrating an example of magnetic-flux paths when the portable electronic device 800 shown in FIG. 17 is held over a RFID reader/writer. In FIG. 19, reference symbol $\phi$ denotes a magnetic flux generated by the reader/writer. As shown in FIG. 19, the portable electronic device 800 is usually held over the reader/writer such that the principal surface of a metallic casing 700 of the portable electronic device 800 is parallel to the principal surface of the reader/writer.

However, magnetic-shielding objects such as the metallic casing 700 are located between the antenna coil 600 and the reader/writer in the structure shown in Patent Document 1, and the magnetic flux is blocked by the metallic casing 700. Therefore, almost no magnetic flux passes through the antenna coil. Furthermore, the axial direction of the magnetic core 601 of the antenna coil 600 is parallel to the surface of the substrate 500. Therefore, the antenna coil 600 cannot be interlinked with the magnetic flux generated by the reader/writer (magnetic flux orthogonal to the axial direction of the antenna coil 600), and cannot communicate with the reader/writer.

Similarly, almost no magnetic flux orthogonal to the axial directions of the magnetic core 611 passes through the antenna coil 610 shown in Patent Document 2 since the magnetic flux is blocked by the substrate and the metallic casing. The antenna coil 610 has a portion without a coil at a position where the first leg portion 611*a* and the second leg portion 611*b* of the L-shaped magnetic core 611 intersect each other at a right angle, and can be interlinked with the magnetic flux orthogonal to the axial directions at the intersecting portion. However, the magnetic resistance at end surfaces of the magnetic core 611 is large since the antenna coil 610 is disposed in the central area of the substrate. This prevents the magnetic flux from being guided into the antenna coil 610. That is, the antenna coil 610 described in Patent Document 2 also cannot be interlinked with the magnetic flux generated by the reader/writer (magnetic flux orthogonal to the axial directions of the magnetic core 611), and cannot communicate with the reader/writer.

SUMMARY OF THE INVENTION

Accordingly, an object of the present invention is to provide a portable electronic device capable of appropriately being interlinked with a magnetic flux orthogonal to the axial direction of a magnetic core and capable of performing highly sensitive communication during communication with external devices such as RFID readers/writers.

To solve the above-described problems, the present invention has the following structure.

According to the invention, a portable electronic device includes a circuit board and an antenna coil installed on the circuit board. The antenna coil includes a magnetic core and a coil wound around the magnetic core and separated into a first coil portion and a second coil portion such that an unwound portion lies at the intermediate portion of the magnetic core in a longitudinal direction of the magnetic core. The winding directions of the first coil portion and the second coil portion differ from each other. The length X of the magnetic core and the distance Y between two intersecting points at which a virtual line formed by projecting the central line of the magnetic core onto the circuit board intersects the outer periphery of the circuit board satisfy $Y \geqq X \geqq 0.8Y$.

According to the invention, the portable electronic device is characterized in that the distance D1 between points x1 and y1 is equal to the distance D2 between points x2 and y2, where two intersecting points at which the virtual line intersects end surfaces of the magnetic core are defined as x1 and x2, one of two intersecting points at which the virtual line intersects the outer periphery of the circuit board closer to the point x1 is defined as y1, and the other intersecting point closer to the point x2 is defined as y2.

The portable electronic device is further characterized in that the circuit board is rectangular, and the axial direction of the magnetic core corresponds to the lateral direction of the circuit board.

According to the invention, the portable electronic device is characterized in that an electrode is formed on at least one surface of the magnetic core at the unwound portion.

According to the invention, the portable electronic device is characterized in that the electrode has at least one slit.

According to the invention, the portable electronic device is characterized in that the magnetic core has a raised portion projecting in the thickness direction of the magnetic core at the unwound portion.

According to the invention, the portable electronic device is characterized in that a coil is wound around the outer periphery of the raised portion.

According to the invention, the portable electronic device is characterized in that the magnetic core has at least one cut-off portion at the unwound portion.

According to the invention, the portable electronic device is characterized in that the cut-off portion is formed on a surface of the magnetic core facing the circuit board.

According to the invention, the portable electronic device is characterized in that the cut-off portion is formed on a side surface of the magnetic core perpendicular to the circuit board.

According to the invention, the portable electronic device is characterized in that the number of turns of the first coil portion and the number of turns of the second coil portion differ from each other.

According to the invention, the portable electronic device is characterized in that the antenna coil is installed over the circuit board so as to be separated from the circuit board at a distance, and the electrode is formed on the surface of the magnetic core facing the circuit board.

According to the invention, a portable electronic device includes a circuit board and an antenna coil installed on the circuit board. The antenna coil includes a first magnetic core and a second magnetic core around which a coil is wound. The winding direction of a first coil portion wound around the first magnetic core differs from the winding direction of a second coil portion wound around the second magnetic core. The first magnetic core and the second magnetic core are juxtaposed to each other such that the axes of the first coil portion and the second coil portion correspond to each other and so as to have a gap between the first magnetic core and the second magnetic core. The length X of the antenna coil in the axial direction and the distance Y between two intersecting points at which a virtual line formed by projecting the central line of the antenna coil in the axial direction onto the circuit board intersects the outer periphery of the circuit board satisfy $Y \geqq X \geqq 0.8Y$.

According to the invention, the portable electronic device is characterized in that the distance D1 between points x1 and y1 is equal to the distance D2 between points x2 and y2, where two intersecting points at which the virtual line intersects both end surfaces of the antenna coil in the axial direction are defined as x1 and x2, one of two intersecting points at which the virtual line intersects the outer periphery of the circuit board closer to the point x1 is defined as y1, and the other intersecting point closer to the point x2 is defined as y2.

According to the invention, the portable electronic device is characterized in that the length A of the antenna coil in the axial direction and the distance B between the first magnetic core and the second magnetic core satisfy $0.6A \geqq B \geqq 0.4A$.

According to the invention, the portable electronic device is characterized in that the circuit board is rectangular, and the axial direction of the antenna coil corresponds to the lateral direction of the circuit board.

According to the invention, the portable electronic device is characterized in that the antenna coil is installed over the circuit board so as to be separated from the circuit board at a distance, and an electrode is formed on surfaces of the first magnetic core and the second magnetic core facing the circuit board.

According to the invention, the portable electronic device is characterized in that the first coil portion and the second coil portion are connected to each other using a conductor formed on the circuit board.

According to the invention, the portable electronic device is characterized in that the first coil portion and the second coil portion are connected to each other using a conductor formed on a flexible substrate.

According to the present invention, the following effects can be obtained.

According to a first invention, the antenna coil of the portable electronic device includes a magnetic core and a coil wound around the magnetic core and separated into a first coil portion and a second coil portion such that an unwound portion lies at the intermediate portion of the magnetic core in a longitudinal direction of the magnetic core, and the winding direction of the coil is changed at either side of the unwound portion. With this structure, the antenna coil can be interlinked with a magnetic flux that is generated by an external device such as a reader/writer and is orthogonal to the axial direction of the magnetic core during communication with the reader/writer even when the portable electronic device is held over the reader/writer such that the principal surface of the portable electronic device is parallel to the principal surface of the reader/writer, and can communicate with the reader/writer. Moreover, the length X of the magnetic core and the distance Y between two intersecting points at which a virtual line formed by projecting the central line of the magnetic core in the axial direction onto the circuit board intersects the outer periphery of the circuit board satisfy $Y \geqq X \geqq 0.8Y$. With this structure, the magnetic resistance of the magnetic core can be reduced by bringing the end surfaces of the magnetic core in the axial direction close to the outer periphery of the circuit board. Thus, the magnetic flux can be collected at the antenna coil, and the antenna coil can be appropriately interlinked with the magnetic flux orthogonal to the axial direction of the magnetic core. In this manner, the communication sensitivity can be further increased.

When the circuit board is rectangular, the axial direction of the magnetic core preferably corresponds to the lateral direction of the circuit board. With this arrangement, a larger amount of magnetic flux can be collected at the antenna coil as compared with the case where the axial direction of the magnetic core corresponds to the longitudinal direction of the circuit board. That is, part of magnetic flux that is generated by the external device and is orthogonal to the axial direction of the magnetic core is bent so as to avoid magnetic-shielding objects such as the circuit board and a metallic casing of the portable electronic device, and detours to side surfaces of the portable electronic device also in the antenna coil used in the portable electronic device according to the present invention. At this moment, the amount of magnetic flux that detours in the lateral direction of the circuit board is larger than that of the magnetic flux that detours in the longitudinal direction since the magnetic resistance in the lateral direction is smaller than that in the longitudinal direction. Thus, the magnetic core disposed such that the axial direction thereof corresponds to the lateral direction of the circuit board can collect a larger amount of magnetic flux in the lateral direction of the circuit board at the antenna coil. Moreover, the size of the antenna coil can be reduced when the axial direction of the magnetic core corresponds to the lateral direction of the circuit board. That is, the magnetic core satisfies the inequality expression $Y \geqq X \geqq 0.8Y$ with respect to the lateral direction of the circuit board, and the length of the magnetic core can be reduced as compared with the case where the magnetic core satisfies the above-described inequality expression with respect to the longitudinal direction. Moreover, the volume of the magnetic core can also be reduced.

Moreover, the distance D1 between points x1 and y1 is preferably equal to the distance D2 between points x2 and y2, where two intersecting points at which the virtual line intersects the end surfaces of the magnetic core are defined as x1 and x2, one of two intersecting points at which the virtual line intersects the outer periphery of the circuit board closer to the point x1 is defined as y1, and the other intersecting point closer to the point x2 is defined as y2. With this structure, the magnetic resistance at both end surfaces of the magnetic core in the axial direction can be substantially equalized, and the amount of magnetic flux that enters the antenna coil located at either end of the unwound portion can be equalized.

Moreover, an electrode is preferably formed on at least one surface of the magnetic core at the unwound portion. With this structure, the magnetic flux can be prevented from leaking and can be guided into the antenna coil, resulting in an increase in the electromotive force of the antenna coil. The electrode preferably has a slit since the inductance of the coil can be easily adjusted.

Moreover, the magnetic core preferably has a raised portion extending in the thickness direction of the magnetic core at the unwound portion. With this structure, the ability to collect the magnetic flux of the antenna coil can be enhanced, and the electromotive force of the antenna coil can be increased. Furthermore, the ability to collect the magnetic flux can be further increased when a coil is wound around the raised portion.

Moreover, the magnetic core preferably has at least one cut-off portion at the unwound portion. With this structure, paths of the magnetic flux that is orthogonal to the axial direction of the magnetic core and enters the unwound portion can be bent in the axial direction of the magnetic core more easily and reliably. Thus, the communication sensitivity can be further increased. According to another effect of this structure, the space inside the portable electronic device can be effectively used since the volume of the antenna coil can be reduced due to the cut-off portion. The cut-off portion can be formed on a surface of the magnetic core facing the circuit board at the unwound portion, or can be formed on a side surface of the magnetic core perpendicular to the circuit board at the unwound portion.

Moreover, the number of turns of the first coil portion and the number of turns of the second coil portion, the first coil portion and the second coil portion having the unwound portion being interposed between the first and second coil portions, can differ from each other. With this structure, the antenna coil can be interlinked with the magnetic flux parallel to the axial direction of the magnetic core in addition to the magnetic flux orthogonal to the axial direction of the magnetic core.

Moreover, the antenna coil can be installed over the circuit board so as to be separated from the circuit board at a distance. With this structure, the antenna coil does not come into contact with the circuit board, and does not influence the performance of the circuit formed on the circuit board.

Moreover, according to a second invention, the antenna coil of the portable electronic device includes a first magnetic core and a second magnetic core juxtaposed to each other so as to have a gap therebetween, and the winding direction of a first coil portion wound around the first magnetic core differs from the winding direction of a second coil portion wound around the second magnetic core. With this structure, the antenna coil can be interlinked with the magnetic flux that is generated by the external device and is orthogonal to the axial direction of the antenna coil, and can communicate with the reader/writer. Moreover, the length X of the antenna coil and the distance Y between two intersecting points at which a virtual line formed by projecting the central line of the antenna coil in the axial direction onto the circuit board intersects the outer periphery of the circuit board satisfy $Y \geqq X \geqq 0.8Y$. With this structure, the magnetic resistance of the antenna coil can be reduced by bringing the end surfaces of the antenna coil in the axial direction close to the outer periphery of the circuit board. Thus, the magnetic flux can be collected at the antenna coil, and the antenna coil can be appropriately interlinked with the magnetic flux orthogonal to the axial direction of the antenna coil. In this manner, the communication sensitivity can be further increased.

Moreover, the length A of the antenna coil in the axial direction and the distance B between the first magnetic core and the second magnetic core preferably satisfy $0.6A \geqq B \geqq 0.4A$. With this structure, the communication sensitivity is not markedly degraded even when the first magnetic core and the second magnetic core are juxtaposed to each other so as to have a gap therebetween.

Moreover, the conductor connecting the first coil portion and the second coil portion can be formed on the circuit board, or can be formed on a flexible substrate. With these structures, the antenna coil can be mounted on the circuit board using various methods.

REFERENCE NUMERALS

Figure 1:
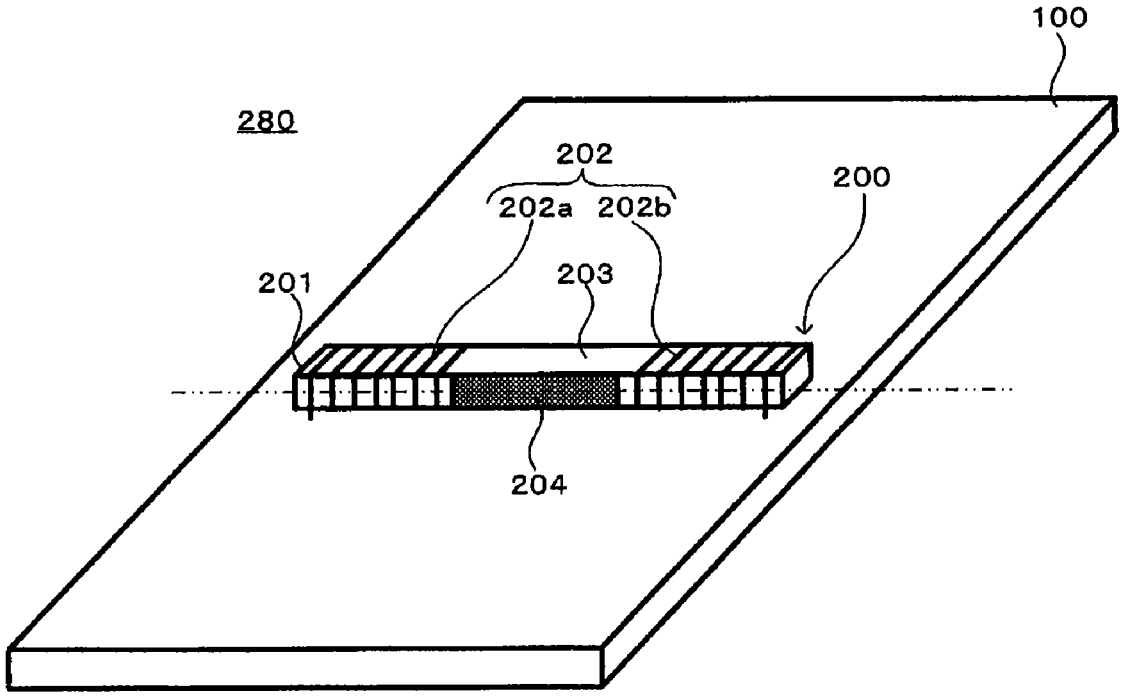
FIGS. 1(A) and 1(B) illustrate the principal part of a portable electronic device according to a first embodiment.
Figure 1:
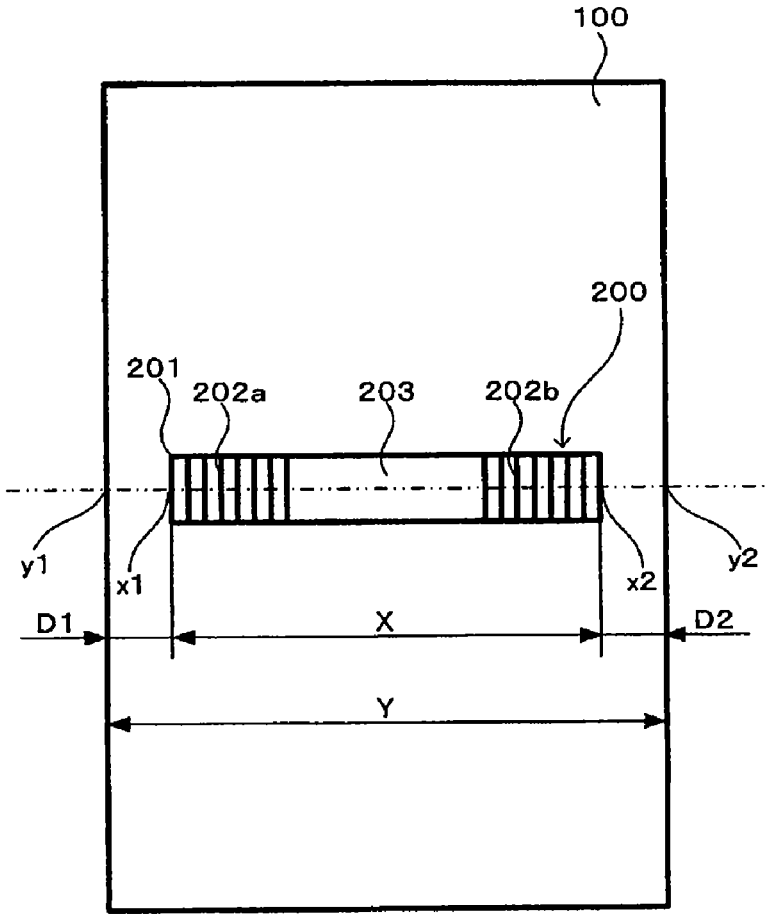

100, 300 circuit boards
200, 400 antenna coils
280, 480 portable electronic devices
201 magnetic core
401*a* first magnetic core
401*b* second magnetic core
202 coil
202*a* first coil portion
202*b* second coil portion
402*a* first coil portion
402*b* second coil portion
203 unwound portion
204 electrodes
205 coil at raised portion
206 cut-off portion
207 slits
208, 408 electrodes
300 metallic casing
460 connecting conductor
470 flexible substrate

DETAILED DESCRIPTION OF THE INVENTION

First Embodiment

Portable electronic device according to a first embodiment will now be described with reference to FIGS. 1(A), 1(B), and 2.

FIGS. 1(A) and 1(B) illustrate the principal part of the portable electronic device according to the first embodiment. FIG. 1(A) is a perspective view, and FIG. 1(B) is a plan view. FIG. 2 is a schematic view illustrating an example of magnetic-flux paths when the portable electronic device shown in FIGS. 1(A) and 1(B) is held over a RFID reader/writer.

A portable electronic device 280 according to the first embodiment includes a circuit board 100 and an antenna coil 200 installed on the circuit board 100. The circuit board 100 is formed of a rectangular circuit substrate having a length of 90 mm and a width of 45 mm, for example. The antenna coil 200 includes a magnetic core 201 composed of ferrite or the like and a coil 202 wound around the outer periphery of the magnetic core 201. The magnetic core 201 is a rectangular parallelepiped core having a length of 45 mm, a width of 5 mm, a thickness of 2.4 mm, and a Q-factor of 100. The coil 202 includes a first coil portion 202*a* and a second coil portion 202*b* separately wound around the magnetic core 201 such that an unwound portion 203 lies at the intermediate portion of the magnetic core 201 in the longitudinal direction thereof. The winding directions of the first coil portion 202*a* and the second coil portion 202*b* differ from each other. Moreover, the coil 202 is wound for seven turns at either side of the unwound portion 203 such that both ends of the magnetic core 201 in the longitudinal direction thereof project from the coil 202 by 1 mm.

Moreover, the magnetic core 201 has electrodes 204 formed of thin films of metal such as aluminum disposed on a side surface that faces the circuit board 100 and on both side surfaces that are perpendicular to the circuit board 100 at the unwound portion 203. That is, the electrodes 204 are formed on all side surfaces of the magnetic core 201 at the unwound portion 203 except for a side surface opposing the side surface that faces the circuit board 100. A magnetic flux generated by a reader/writer (described below) enters the side surface having no electrodes 204.

Figure 2:
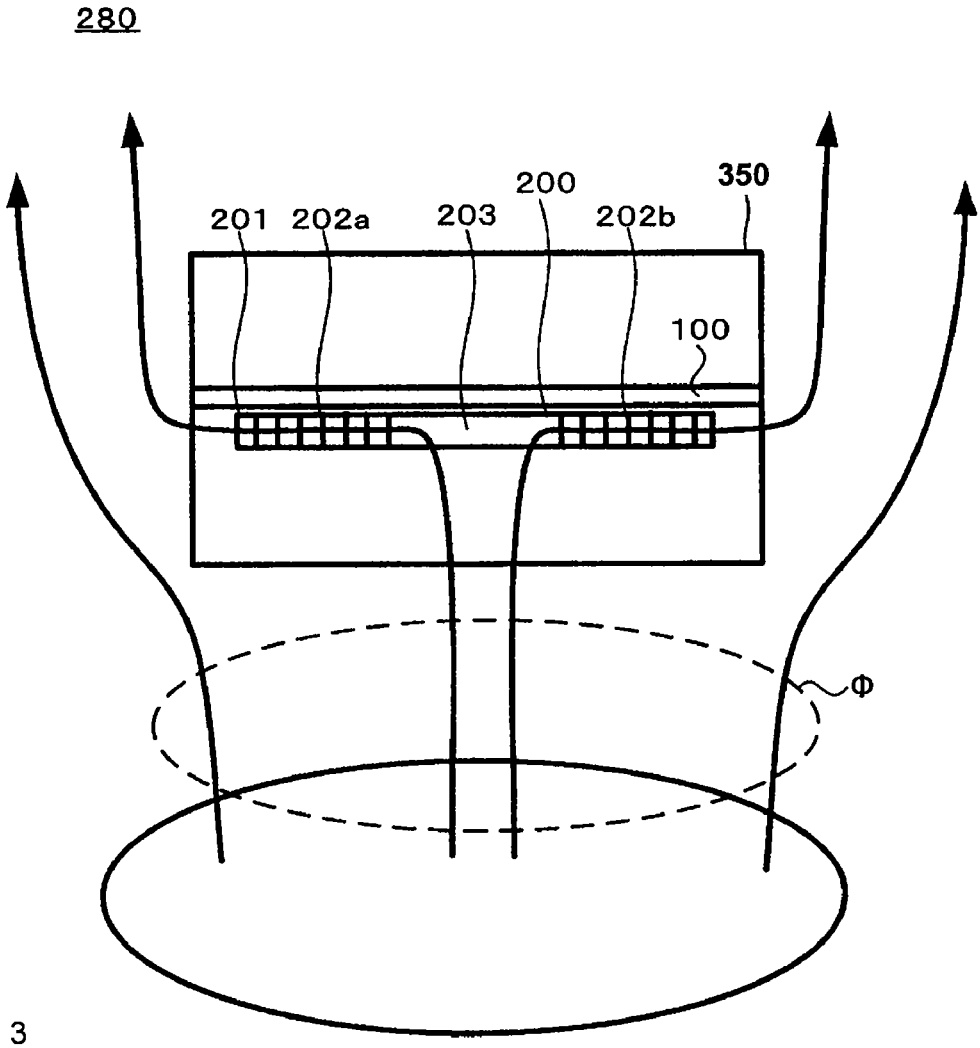
FIG. 2 is a schematic view illustrating an example of magnetic-flux paths when the portable electronic device shown in FIGS. 1(A) and 1(B) is held over a RFID reader/writer.

In FIG. 2, reference symbol $\phi$ denotes the magnetic flux generated by the reader/writer. As shown in FIG. 2, the portable electronic device 280 is usually held over the reader/writer such that the principal surface of a metallic casing 350 of the portable electronic device 280 is parallel to the principal surface of the reader/writer. As clearly shown in FIG. 2, the antenna coil 200 can capture and be interlinked with the magnetic flux substantially orthogonal to the axial direction thereof since the antenna coil 200 includes the unwound portion 203 at the intermediate portion thereof. That is, since the winding directions of the first coil portion 202*a* and the second coil portion 202*b* of the coil 202 differ from each other, the magnetic flux generated by the reader/writer and entering the unwound portion 203 (magnetic flux orthogonal to the axial direction of the magnetic core 201) is bent substantially by 90° along the axial direction of the coil 202, and travels toward the first coil portion 202*a* and the second coil portion 202*b*. In this manner, the coil 202 can capture and be interlinked with the magnetic flux that is generated by the reader/writer and is orthogonal to the axial direction of the magnetic core 201 at either the first coil portion 202*a* or the second coil portion 202*b*.

Research studies described in an experimental example (described below) conducted by the inventors proved the followings. That is, when the length X of the magnetic core in the longitudinal direction and the distance Y between two intersecting points at which the virtual line formed by projecting the central line of the magnetic core in the axial direction onto the circuit board intersects the outer periphery of the circuit board shown in FIG. 1(B) satisfy $Y \geqq X \geqq 0.8Y$, the antenna coil can be appropriately interlinked with the magnetic flux that is generated by the reader/writer and is orthogonal to the axial direction of the magnetic core, and can perform highly sensitive communication with the reader/writer. When this embodiment is applied to the above-described inequality expression, the inequality expression can be satisfied. Therefore, the antenna coil 200 can be appropriately interlinked with the magnetic flux that is generated by the reader/writer and is orthogonal to the axial direction of the magnetic core 201, and can perform highly sensitive communication.

Moreover, as shown in FIG. 1(B), the antenna coil 200 according to this embodiment is disposed such that the distance D1 between points x1 and y1 is equal to the distance D2 between points x2 and y2 (herein, two intersecting points at which the virtual line intersects the end surfaces of the magnetic core 201 are defined as x1 and x2, one of two intersecting points at which the virtual line intersects the outer periphery of the circuit board 100 closer to the point x1 is defined as y1, and the other intersecting point closer to the point x2 is defined as y2). Therefore, the magnetic resistance at the end surfaces of the magnetic core 201 in the axial direction can be substantially equalized. Moreover, the amount of magnetic flux that enters the coil 202 located at either end of the unwound portion 203 can be equalized.

Furthermore, the antenna coil 200 according to this embodiment is disposed such that the axial direction of the magnetic core 201 corresponds to the lateral direction of the circuit board 100. With this arrangement, a larger amount of magnetic flux can be collected at the antenna coil as compared with the case where the axial direction of the magnetic core 201 corresponds to the longitudinal direction of the circuit board 100. That is, part of magnetic flux that is generated by an external device and is orthogonal to the axial direction of the magnetic core 201 is bent so as to avoid magnetic-shielding objects such as the circuit board 100 and the metallic casing 350 of the portable electronic device 280, and detours to side surfaces of the portable electronic device 280 also in this embodiment. At this moment, the amount of magnetic flux that detours in the lateral direction of the circuit board 100 is larger than that of the magnetic flux that detours in the longitudinal direction since the magnetic resistance in the lateral direction is smaller than that in the longitudinal direction. Thus, the magnetic core disposed such that the axial direction thereof corresponds to the lateral direction of the circuit board 100 can collect a larger amount of magnetic flux in the lateral direction. Moreover, the size of the antenna coil can be reduced. That is, the magnetic core 201 satisfies the inequality expression $Y \geqq X \geqq 0.8Y$ with respect to the lateral direction of the circuit board 100, and the length of the magnetic core 201 can be reduced as compared with the case where the magnetic core 201 satisfies the above-described inequality expression with respect to the longitudinal direction. Moreover, the volume of the magnetic core 201 can also be reduced.

EXPERIMENTAL EXAMPLE

Figure 3:
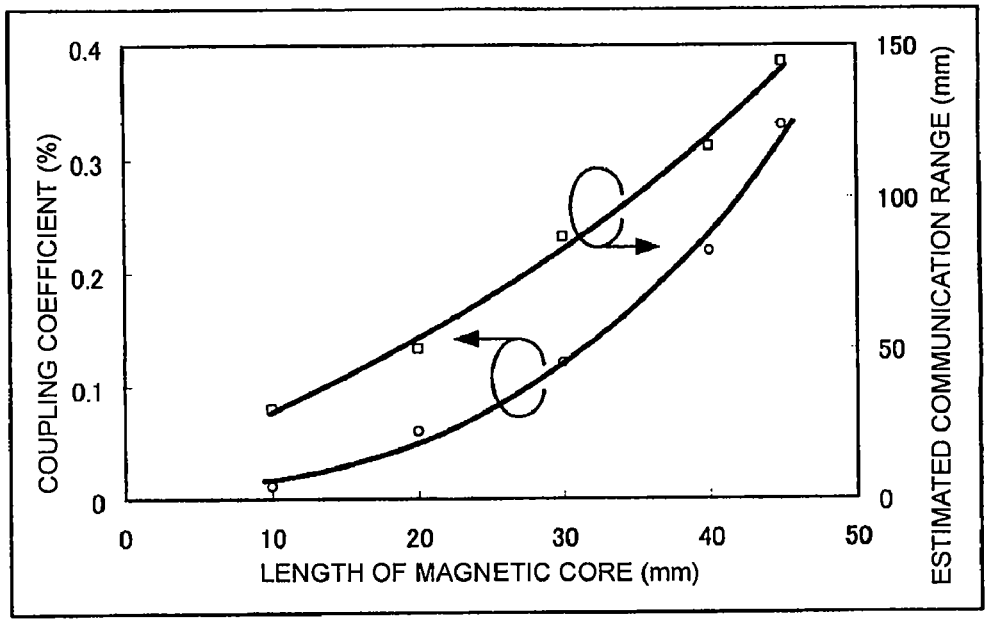
FIG. 3 illustrates changes in a coupling coefficient and an estimated communication range when the length of a magnetic core of an antenna coil according to the first embodiment is changed from a basic dimension.
Figure 4:
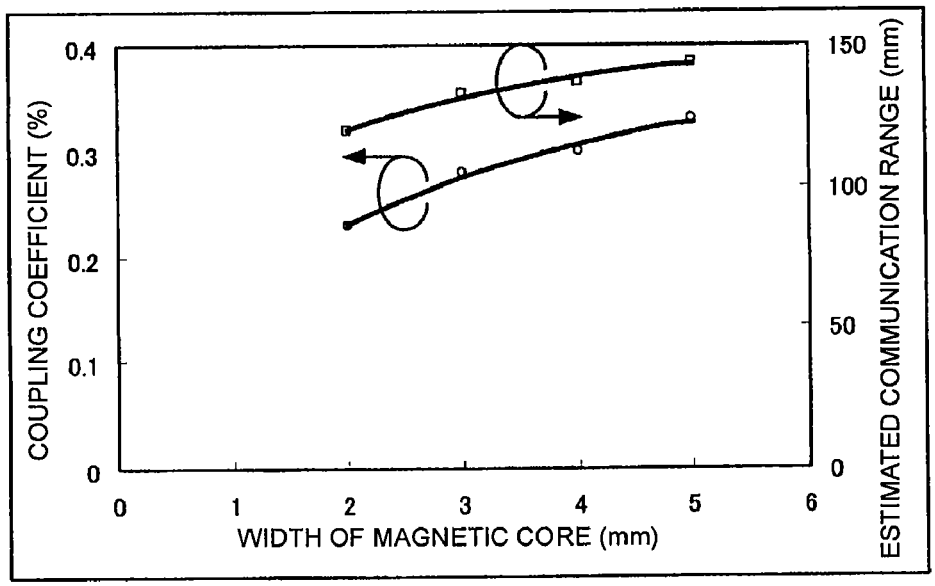
FIG. 4 illustrates changes in the coupling coefficient and the estimated communication range when the width of the magnetic core of the antenna coil according to the first embodiment is changed from the basic dimension.
Figure 5:
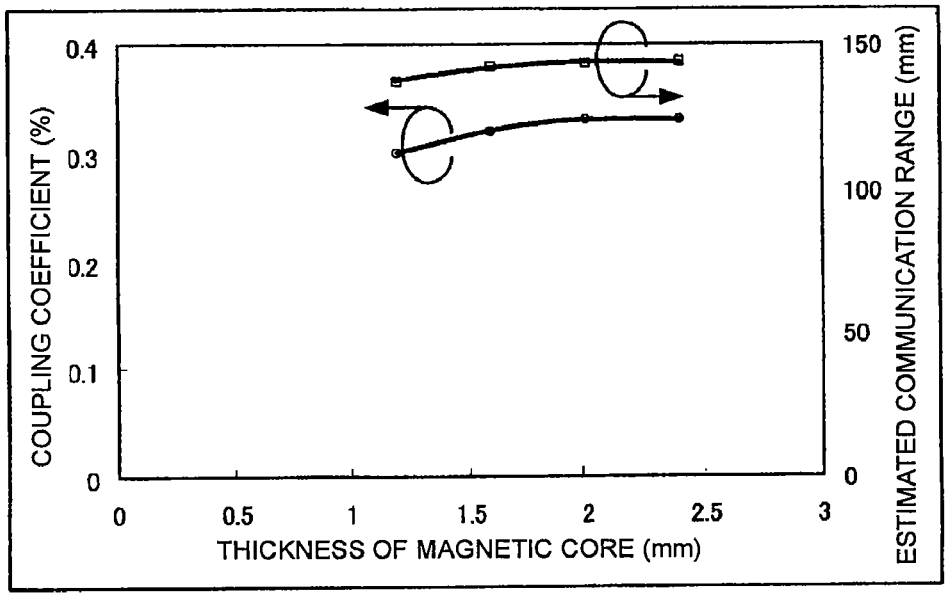
FIG. 5 illustrates changes in the coupling coefficient and the estimated communication range when the thickness of the magnetic core of the antenna coil according to the first embodiment is changed from the basic dimension.

FIGS. 3 to 5 illustrate changes in coupling coefficients between the antenna coil 200 and a magnetic flux generated by a reader and estimated communication ranges when the length, width, and thickness of the magnetic core 201 of the antenna coil 200 according to the first embodiment are changed from the basic dimensions. FIGS. 3, 4, and 5 illustrate changes in the coupling coefficients and the estimated communication ranges when the length, width, and thickness, respectively, are changed. The magnetic core 201 of the antenna coil 200 in this experimental example has basic dimensions of 45 mm in length, 5 mm in width, and 2.4 mm in thickness, and has a Q-factor of 100. The coil 202 is wound for seven turns at either side of the unwound portion 203 such that both ends of the magnetic core 201 in the longitudinal direction thereof project from the coil 202 by 1 mm. The circuit board 100 has a length of 90 mm, a width of 45 mm, and an electrical conductivity $\sigma$ of $0.60\times10^6$. The antenna coil 200 is disposed such that the axial direction thereof is substantially parallel to the lateral direction of the circuit board 100.

It has been already confirmed that the antenna coil 200 can be appropriately interlinked with the magnetic flux that is generated by a reader/writer and is orthogonal to the axial direction of the magnetic core 201, and can perform highly sensitive communication when the antenna coil 200 having the basic dimensions installed on the circuit board 100 is used for communication with the reader/writer that is remote from the antenna coil 200 by 100 mm. Therefore, changes in the coupling coefficients and the estimated communication ranges when the size of the antenna coil 200 is reduced from the basic dimensions will be shown in this experimental example. In this experimental example, the term "highly sensitive communication" indicates communication with a sensitivity at a level more than or equal to that required for satisfying market needs. More specifically, the term indicates communication with a coupling coefficient of 0.18% or more when the distance between the antenna coil 200 and the reader/writer is 100 mm. That is, when the coupling coefficient is 0.18% or more, the antenna coil can ensure a communication range of 100 mm.

The magnetic core 201 of the antenna coil 200 shown in FIG. 3 has a length ranging from 10 to 45 mm, a width of 5 mm, and a thickness of 2.4 mm.

The magnetic core 201 of the antenna coil 200 shown in FIG. 4 has a length of 45 mm, a width ranging from 2 to 5 mm, and a thickness of 2.4 mm.

The magnetic core 201 of the antenna coil 200 shown in FIG. 5 has a length of 45 mm, a width of 5 mm, and a thickness ranging from 1.2 to 2.4 mm.

As clearly shown in FIG. 3, the coupling coefficient is reduced in proportion to the length of the magnetic core 201. For example, when the length of the magnetic core 201 is reduced to 30 mm, the coupling coefficient is reduced to 0.12%, and only the estimated communication range of 87 mm can be ensured. Therefore, when the length of the magnetic core 201 is reduced to 30 mm, communication sensitivity at the level required for satisfying market needs cannot be achieved.

In contrast, as shown in FIG. 4, the coupling coefficient is not markedly changed even when the width of the magnetic core 201 is reduced. This indicates that excellent communication can be ensured. For example, the coupling coefficient of 0.28% can be achieved even when the width is set to 2 mm, and the estimated communication range of 100 mm or more can be ensured.

Moreover, as shown in FIG. 5, the coupling coefficient is not markedly changed even when the thickness, i.e., height, of the magnetic core 201 is reduced. This indicates that excellent communication can be ensured. For example, the coupling coefficient of 0.30% can be achieved even when the thickness is set to 1.2 mm, and an amount of coupling that ensures the estimated communication range of 100 mm or more can be achieved.

The experimental results shown in FIGS. 3 to 5 show that the most influential dimension in the amount of coupling between the antenna coil 200 and the magnetic flux of the reader/writer is the length of the magnetic core 201 among the length, width, and thickness of the magnetic core 201. Moreover, it is shown that the coupling coefficient of 0.18% or more can be achieved by setting the length of the magnetic core 201 of the antenna coil 200 to at least 36 mm, and the antenna coil 200 can perform highly sensitive communication with the reader/writer at a level more than or equal to that required for satisfying market needs.

Moreover, the experimental results show that when the distance X between two intersecting points at which the central line of the magnetic core 201 in the axial direction intersects end surfaces of the magnetic core 201 and the distance Y between two intersecting points at which the virtual line formed by projecting the central line onto the circuit board 100 intersects the outer periphery of the circuit board 100 shown satisfy $Y \geqq X \geqq 0.8Y$, the antenna coil 200 can be appropriately interlinked with the magnetic flux generated by the reader/writer (magnetic flux orthogonal to the axial direction of the magnetic core 201), and can perform highly sensitive communication. In the above-described inequality expression, the lower limit of X ($X \geqq 0.8Y$) indicates the minimum length of the magnetic core required for ensuring the coupling coefficient of 0.18% or more determined from the drawing, and the upper limit of X ($Y \geqq X$) is set to the same length as that of the circuit board 100 in the lateral direction.

The inventors considered the reason the most influential dimension in the amount of coupling of the magnetic flux was the length to be as follows. That is, when magnetic-shielding objects such as the circuit board 100 and the metallic casing 350 that block the magnetic flux generated by the reader are disposed between the reader/writer and the antenna coil 200 as in this experimental example, the magnetic resistance at both ends of the magnetic core 201 in the axial direction is reduced by increasing the length of the magnetic core 201 in the axial direction such that both ends of the magnetic core 201 in the axial direction are brought close to the outer periphery of the circuit board 100. With this, the magnetic flux can pass through the magnetic core 201 more easily, and the amount of coupling between the antenna coil 200 and the magnetic flux generated by the reader/writer is increased.

Moreover, the inventors found that degradation of communication sensitivity is small and communication with a required sensitivity can be achieved even when the width and thickness of the magnetic core 201 in this experimental example are reduced, for example, to half the basic dimensions or less. That is, when the volume of the antenna coil 200 is constant, the sensitivity of the antenna coil 200 can be increased by increasing the length of the magnetic core 201 and reducing the width and thickness. Moreover, when the sensitivity of the antenna coil 200 is constant, a smaller antenna coil 200 having a small volume can be realized by increasing the length of the magnetic core 201 and reducing the width and thickness.

In the first embodiment, the electrodes 204 are formed on all the side surfaces of the magnetic core 201 at the unwound portion 203 except for the side surface opposing the side surface that faces the circuit board 100, that is, formed on the side surface that faces the circuit board 100 and on both side surfaces that are perpendicular to the circuit board 100. However, the present invention is not limited to this embodiment. In the antenna coil 200 according to the present invention, the electrodes 204 can be formed on side surfaces of the magnetic core 201 at the unwound portion 203 except for at least one side surface into which the magnetic flux travels. The electrodes 204 are not necessarily formed in the present invention. However, the electrodes 204 are preferably formed from the viewpoint of increasing the communication sensitivity.

Figure 6:
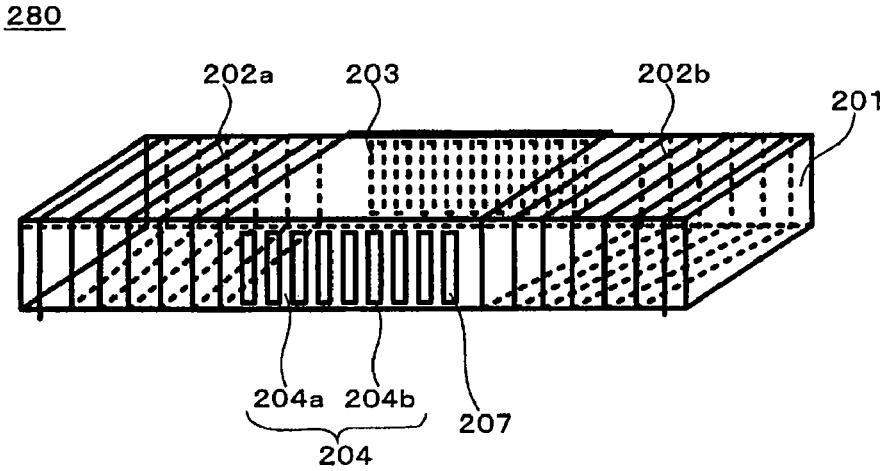
FIGS. 6(A) and 6(B) illustrate a modification of the antenna coil according to the first embodiment.
Figure 6:
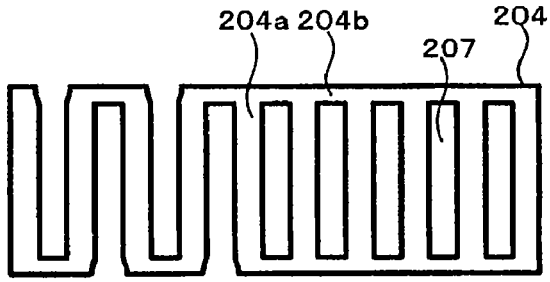

Moreover, as shown in FIGS. 6(A) and 6(B), each of the electrodes 204 can have a ladder shape including a plurality of rung portions 204*a* and stile portions 204*b* that connect the rung portions 204*a*. The ladder-shaped electrodes 204 each have a plurality of slits 207. Since the length of current paths can be changed by trimming parts of the stile portions 204*b* off as shown in FIG. 6(B), the inductance of the coil 202 can be easily adjusted. Each of the electrodes 204 preferably has at least one slit 207 since the inductance of the coil 202 can be easily changed by changing the length of the current paths using trimming.

Figure 7:
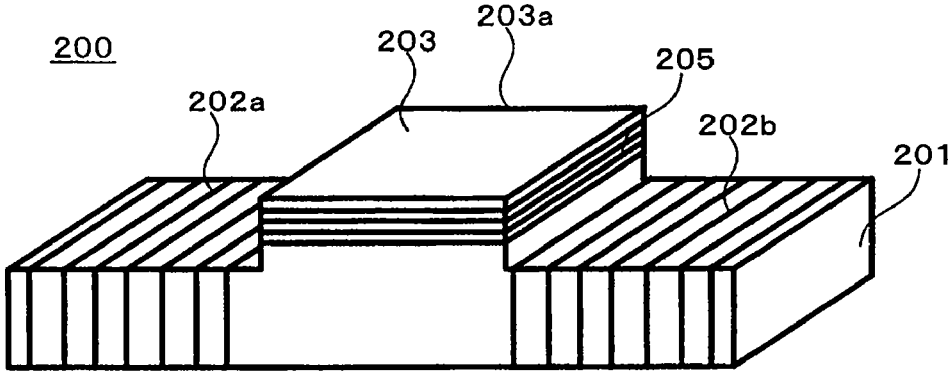
FIG. 7 is a perspective view of another modification of the antenna coil according to the first embodiment.

In the first embodiment, the magnetic core 201 is a rectangular parallelepiped. However, the present invention is not limited to this embodiment, and the magnetic core 201 can have other shapes, for example, a cylindrical shape or a triangular prismatic shape. Furthermore, as shown in FIG. 7, the magnetic core 201 can have a raised portion 203*a* projecting in the thickness direction at the unwound portion 203, and a coil 205 can be wound around the raised portion 203*a*. With this structure, the ability to collect the magnetic flux of the magnetic core 201 can be enhanced such that a larger amount of magnetic flux can be guided into the antenna coil 200. Thus, the electromotive force can be increased, and the communication sensitivity can be further increased.

Figure 8:
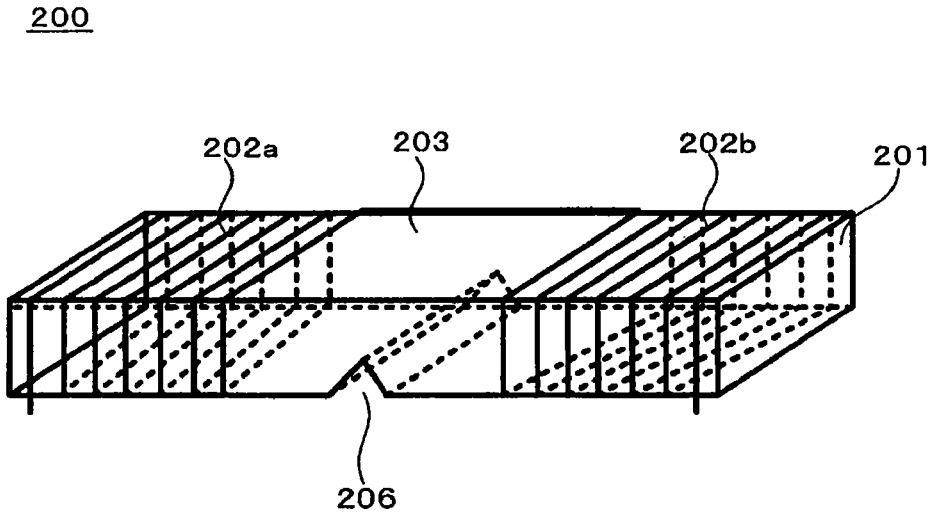
FIG. 8 is a perspective view of another modification of the antenna coil according to the first embodiment.

Moreover, as shown in FIG. 8, the antenna coil 200 according to the present invention can have a cut-off portion 206 formed on the side surface of the magnetic core 201, the side surface facing the circuit board. The cut-off portion 206 shown in FIG. 8 is formed by cutting a triangular prismatic portion off the magnetic core 201. With this structure, the magnetic flux that is orthogonal to the axial direction of the magnetic core 201 and enters the unwound portion 203 can be bent in the axial direction of the magnetic core 201 more easily and reliably. Thus, the communication sensitivity can be further increased.

Figure 9:
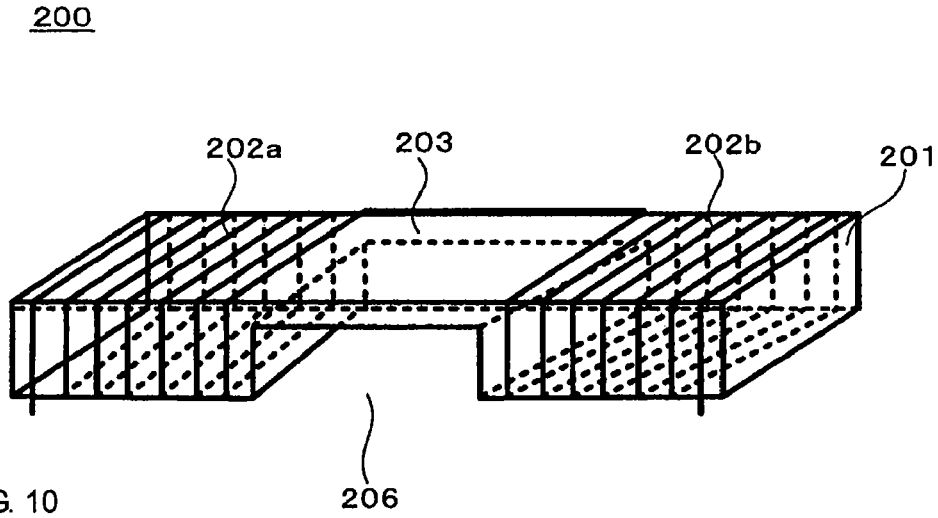
FIG. 9 is a perspective view of another modification of the antenna coil according to the first embodiment.
Figure 10:
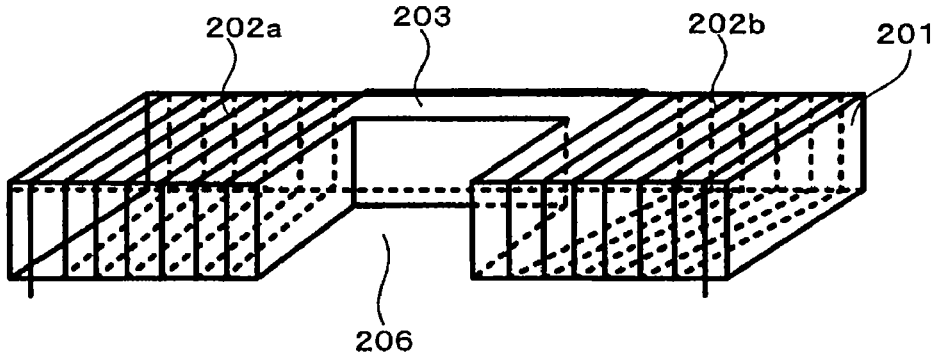
FIG. 10 is a perspective view of another modification of the antenna coil according to the first embodiment.

Moreover, as shown in FIGS. 9 and 10, the cut-off portion 206 can be formed by cutting a rectangular parallelepiped portion off the magnetic core 201. In FIG. 9, the cut-off portion 206 is formed on the side surface that faces the circuit board. With this structure, a gap is formed between the antenna coil 200 and the circuit board at the central portion of the antenna coil 200, and the space formed by the gap can be effectively used. The cut-off portion 206 shown in FIG. 10 is formed on a side surface perpendicular to the circuit board. With this structure, a recessed portion where no magnetic core lies is formed on the board at the central portion of the antenna coil 200, and other components disposed on the circuit board can extend toward this portion. Thus, flexibility in designing the circuit board on which the antenna coil 200 is mounted can be improved.

Figure 11:
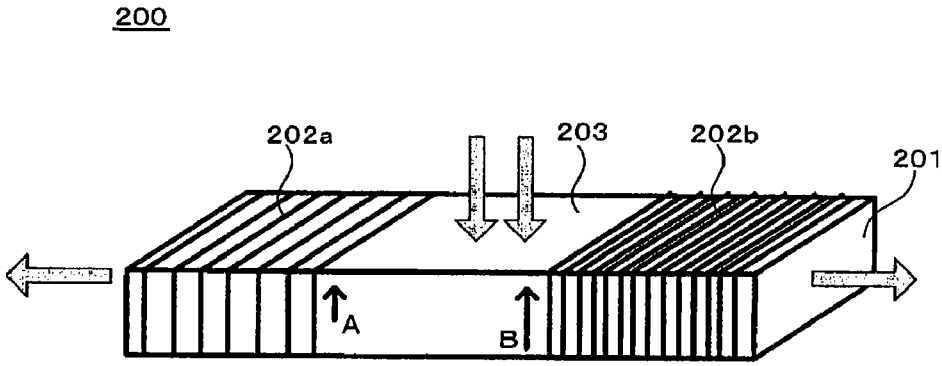
FIGS. 11(A) and 11(B) are perspective views illustrating another modification of the antenna coil according to the first embodiment.
Figure 11:
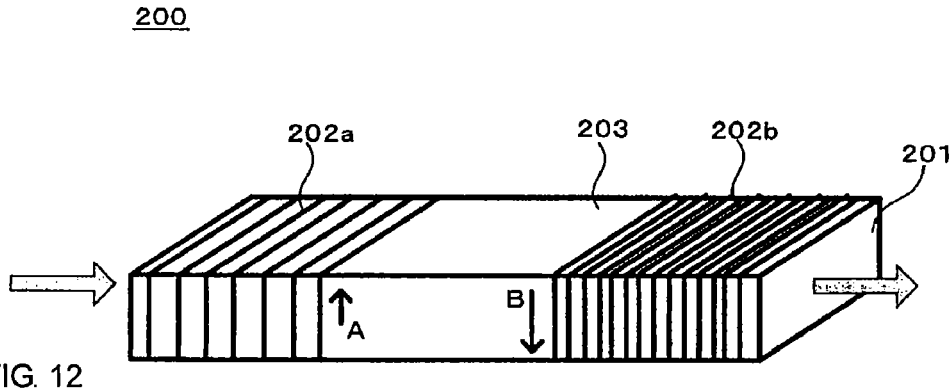

Moreover, in the antenna coil 200 according to the present invention, the number of turns of the first coil portion 202*a* and the number of turns of the second coil portion 202*b*, the unwound portion 203 being interposed between the coil portions 202*a* and 202*b*, can differ from each other. When the ratio of the number of turns of the first coil portion 202*a* to the number of turns of the second coil portion 202*b*, the unwound portion 203 being interposed between the coil portions 202*a* and 202*b*, is, for example, 1:2 in the coil 202 as shown in FIGS. 11(A) and 11(B), the antenna coil 200 can be interlinked with the magnetic flux parallel to the axial direction of the magnetic core 201 in addition to the magnetic flux orthogonal to the axial direction of the magnetic core 201. That is, when a magnetic flux orthogonal to the axial direction of the magnetic core 201 passes through the antenna coil 200, a current A and a current B flowing in the same direction are generated at the first coil portion 202*a* and the second coil portion 202*b*, respectively, as shown in FIG. 11(A). Moreover, when a magnetic flux parallel to the axial direction of the magnetic core 201 passes through the antenna coil 200, a current A and a current B flowing in directions opposite to each other are generated at the first coil portion 202*a* and the second coil portion 202*b*, respectively, as shown in FIG. 11(B). Since the ratio of the number of turns of the first coil portion 202*a* to the number of turns of the second coil portion 202*b*, the unwound portion 203 being interposed between the coil portions 202*a* and 202*b*, is 1:2, i.e., not one, the amounts of currents A and B flowing in directions opposite to each other differ from each other, and the currents A and B do not cancel each other completely. Therefore, even when a portable electronic device is shifted from a position where the principal surface thereof is parallel to the principal surface of a reader/writer such that the magnetic flux generated by the reader/writer becomes parallel to the axial direction of the magnetic core 201, the antenna coil 200 can reliably capture the magnetic flux generated by the reader/writer, and can communicate with the reader/writer. Herein, the ratio of the number of turns of the first coil portion 202*a* to the number of turns of the second coil portion 202*b* is not limited to 1:2, and may be any value as long as the number of turns of the first coil portion 202*a* and that of the second coil portion 202*b* differ from each other.

In the antenna coil 200 according to the present invention, the first coil portion 202*a* and the second coil portion 202*b* can be disposed in parallel.

Second Embodiment

A portable electronic device according to a second embodiment will now be described with reference to FIG. 12.

Figure 12:
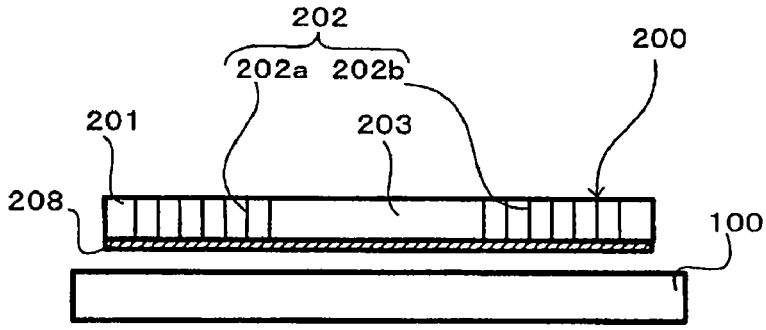
FIG. 12 is a front view illustrating the principal part of a portable electronic device according to a second embodiment.

FIG. 12 is a front view of the portable electronic device according to the second embodiment. In FIG. 12, descriptions of components common to or corresponding to those shown in FIG. 1 illustrating the first embodiment will be omitted as appropriate.

As shown in FIG. 12, a portable electronic device 280 according to the second embodiment includes a circuit board 100 and an antenna coil 200 installed over the circuit board 100. As shown in FIG. 12, the antenna coil 200 is installed over the circuit board 100 so as to be separated from the circuit board 100 at a predetermined distance. The antenna coil 200 is installed over the circuit board 100 at a predetermined distance from the circuit board 100 by, for example, being bonded to a casing located above the circuit board 100. When the circuit board 100 and the antenna coil 200 have a predetermined gap therebetween in this manner, the antenna coil 200 does not come into contact with the circuit board 100, and does not influence the performance of the circuit. Moreover, flexibility in the layout of the antenna coil 200 can be improved since the antenna coil 200 does not come into contact with the circuit board 100.

The antenna coil 200 includes a magnetic core 201. As shown in FIG. 12, an electrode 208 is formed so as to cover the entire surface of the magnetic core 201 facing the circuit board 100. In order to avoid connection of the electrode 208 to a first coil portion 202*a* and a second coil portion 202*b*, the electrode 208 is formed on the surface of the magnetic core 201 facing the circuit board 100 after a nonconductive adhesive or the like is applied to the surface. The electrode 208 formed on the surface of the magnetic core 201 facing the circuit board 100 in this manner can prevent the magnetic flux that enters the magnetic core 201 from leaking into the gap between the magnetic core 201 and the circuit board 100. Thus, reduction in communication sensitivity can be regulated even when a predetermined gap is formed between the circuit board 100 and the antenna coil 200.

The electrode 208 is formed so as to cover the entire surface of the magnetic core 201 facing the circuit board 100 in the second embodiment, but can be formed so as to cover a part of the surface. However, a larger electrode 208 is preferably formed since the larger electrode 208 can prevent the magnetic flux entering the magnetic core 201 from leaking into the gap between the magnetic core 201 and the circuit board 100 more easily.

Third Embodiment

A portable electronic device according to a third embodiment will now be described with reference to FIGS. 13(A) and 13(B).

FIGS. 13(A) and 13(B) illustrate the principal part of the portable electronic device according to the third embodiment. FIG. 13(A) is a perspective view, and FIG. 13(B) is a plan view.

As shown in FIG. 13(A), a portable electronic device 480 according to the third embodiment includes a circuit board 300 and an antenna coil 400 installed on the circuit board 300. The circuit board 300 is formed of a rectangular circuit substrate having a length of 90 mm and a width of 45 mm, for example. The antenna coil 400 is disposed on the circuit board 300 such that the axial direction of the antenna coil 400 corresponds to the lateral direction of the circuit board 300. Herein, the axial direction of the antenna coil corresponds to the axial directions of magnetic cores (described below). The antenna coil 400 includes a first magnetic core 401*a* and a second magnetic core 401*b* composed of ferrite or the like.

The magnetic cores 401*a* and 401*b* are rectangular parallelepiped cores each having a length of 10 mm, a width of 7 mm, a thickness of 1.5 mm, and a Q-factor of 100. The first magnetic core 401*a* and the second magnetic core 401*b* are juxtaposed to each other such that the axes thereof correspond to each other and so as to have a gap therebetween. In this embodiment, the size of the gap is 26 mm.

A coil wound around the first magnetic core 401*a* and the second magnetic core 401*b* constitutes a first coil portion 402*a* and a second coil portion 402*b*, respectively. The first coil portion 402*a* is wound for six turns such that both ends of the first magnetic core in the axial direction thereof project from the first coil portion 402*a* by 1 mm. The second coil portion 402*b* has the same structure as that of the first coil portion 402*a*. The winding directions of the first coil portion 402*a* and the second coil portion 402*b* differ from each other. In this embodiment, coils are wound around the magnetic cores 401*a* and 401*b* such that the lateral directions of the magnetic cores correspond to the axial directions of the coils.

Since the above-described antenna coil 400 includes the first magnetic core 401*a* and the second magnetic core 401*b* juxtaposed to each other so as to have a gap without coils therebetween, the antenna coil 400 can capture and be interlinked with a magnetic flux substantially orthogonal to the axial direction of the antenna coil. That is, since the winding directions of the first coil portion 402*a* and the second coil portion 402*b* differ from each other, the magnetic flux generated by the reader/writer and entering the gap between the first magnetic core 401*a* and the second magnetic core 401*b* (magnetic flux orthogonal to the axial direction of the antenna coil) is bent substantially by 90° along the axial direction of the first magnetic core 401*a* and the second magnetic core 401*b*. In this manner, the antenna coil can capture and be interlinked with the magnetic flux that is generated by the reader/writer and is orthogonal to the axial direction of the antenna coil at either the first magnetic core 401*a* or the second magnetic core 401*b*. Furthermore, the antenna coil 400 has a gap between the first magnetic core 401*a* and the second magnetic core 401*b*, and other components disposed on the circuit board 300 can extend toward the gap. Thus, flexibility in designing the circuit board 300 on which the antenna coil 400 is mounted can be improved.

As in the experimental example, research studies conducted by the inventors proved the followings. That is, when the length X of the antenna coil in the axial direction and the distance Y between two intersecting points at which the virtual line formed by projecting the central line of the antenna coil in the axial direction onto the circuit board intersects the outer periphery of the circuit board shown in FIG. 13(B) satisfy $Y \geqq X \geqq 0.8Y$, the antenna coil can be appropriately interlinked with the magnetic flux that is generated by the reader/writer and is orthogonal to the axial direction of the magnetic cores, and can perform highly sensitive communication with the reader/writer.

When the antenna coil 400 according to this embodiment is applied to the above-described inequality expression, the inequality expression can be satisfied since the length X of the antenna coil 400 in the axial direction thereof is 40 mm and the distance Y between the two intersecting points at which the virtual line formed by projecting the central line of the antenna coil 400 in the axial direction onto the circuit board intersects the outer periphery of the circuit board is 45 mm.

Therefore, the antenna coil 400 can be appropriately interlinked with the magnetic flux that is generated by the reader/writer and is orthogonal to the axial direction of the antenna coil 400, and can perform highly sensitive communication with the reader/writer.

Moreover, as shown in FIG. 13(B), the antenna coil 400 according to this embodiment is disposed such that the distance D1 between points x1 and y1 is equal to the distance D2 between points x2 and y2 (herein, two intersecting points at which the virtual line intersects the end surfaces of the antenna coil 400 are defined as x1 and x2, one of two intersecting points at which the virtual line intersects the outer periphery of the circuit board 300 closer to the point x1 is defined as y1, and the other intersecting point closer to the point x2 is defined as y2). Therefore, the magnetic resistance at the end surfaces of the antenna coil 400 in the axial direction can be substantially equalized. Moreover, the amount of magnetic flux that enters the gap between the first magnetic core 401*a* and the second magnetic core 401*b* can be equalized.

Furthermore, the antenna coil 400 according to this embodiment is disposed such that the axial direction of the antenna coil 400 corresponds to the lateral direction of the circuit board 300. With this arrangement, a larger amount of magnetic flux can be collected at the antenna coil as compared with the case where the axial direction of the antenna coil 400 corresponds to the longitudinal direction of the circuit board 300.

As described above, the portable electronic device 480 according to this embodiment includes the first magnetic core 401*a* and the second magnetic core 401*b* juxtaposed to each other so as to have a gap therebetween. A larger gap prevents the magnetic flux from being guided into the first magnetic core 401*a* and the second magnetic core 401*b*, and the amount of magnetic flux penetrating through the axes of the first coil portion 402*a* and the second coil portion 402*b* is reduced. On the other hand, when the size of the gap is reduced, the portion through which the magnetic flux penetrates becomes small, and the amount of magnetic flux the antenna coil 400 can capture is reduced. Therefore, the distance between the first magnetic core 401*a* and the second magnetic core 401*b* is preferably set to a predetermined length. On the basis of findings of the inventors, when the length A of the antenna coil in the axial direction and the distance B between the first magnetic core 401*a* and the second magnetic core 401*b* satisfy $0.6A \geqq B \geqq 0.4A$, the antenna coil 400 can be appropriately interlinked with the magnetic flux that is generated by the reader/writer and is orthogonal to the axial direction of the antenna coil 400, and can perform highly sensitive communication. Therefore, it is preferable that the distance between the first magnetic core 401*a* and the second magnetic core 401*b* is set in accordance with this condition.

In this embodiment, the above-described condition is satisfied since the length A of the antenna coil 400 in the axial direction is 40 mm, and the distance B between the first magnetic core 401*a* and the second magnetic core 401*b* is 26 mm. Therefore, the antenna coil 400 can be appropriately interlinked with the magnetic flux that is generated by the reader/writer and is orthogonal to the axial direction of the antenna coil 400, and can perform highly sensitive communication with the reader/writer.

In this embodiment, the number of turns of the first coil portion 402*a* and the number of turns of the second coil portion 402*b* are the same. However, the number of turns of the first coil portion 402*a* and the number of turns of the second coil portion 402*b* can differ from each other. When the numbers of turns of the first coil portion 402*a* and the second coil portion 402*b* differ from each other, the antenna coil 400 can be interlinked with a magnetic flux parallel to the axial direction of the antenna coil 400 in addition to that orthogonal to the axial direction of the antenna coil 400.

Fourth Embodiment

A portable electronic device according to a fourth embodiment will now be described with reference to FIG. 14.

Figure 13:
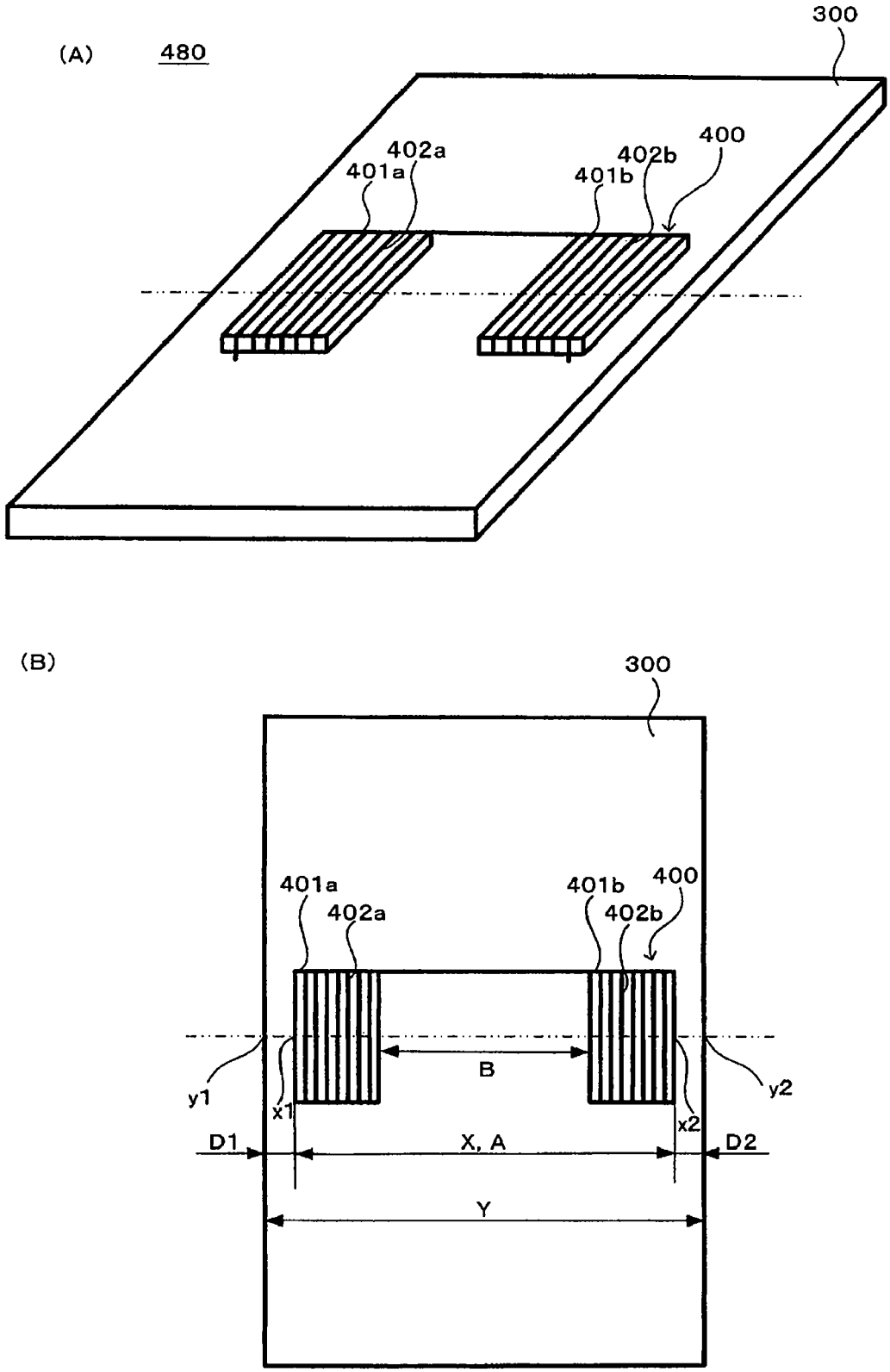
FIGS. 13(A) and 13(B) illustrate the principal part of a portable electronic device according to a third embodiment.
Figure 14:
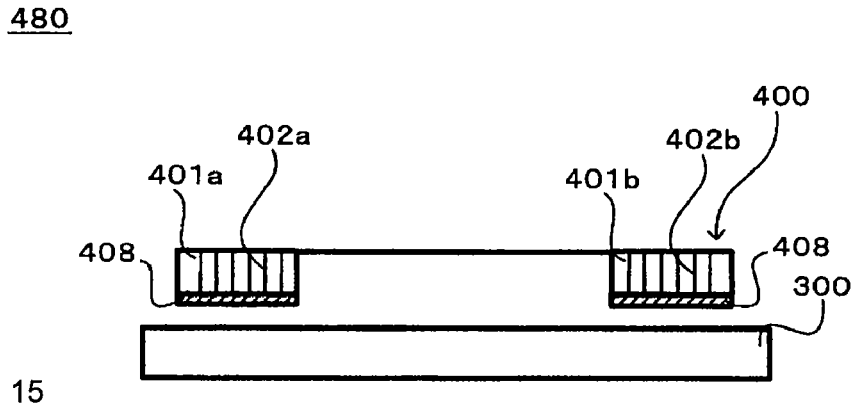
FIG. 14 is a front view illustrating the principal part of a portable electronic device according to a fourth embodiment.

FIG. 14 is a front view of the portable electronic device according to the fourth embodiment. In FIG. 14, descriptions of components common to or corresponding to those shown in FIG. 13 illustrating the third embodiment will be omitted as appropriate.

As shown in FIG. 14, a portable electronic device 480 according to the fourth embodiment includes a circuit board 300 and an antenna coil 400 installed over the circuit board 300. The antenna coil 400 is installed over the circuit board 300 so as to be separated from the circuit board 300 at a predetermined distance. The antenna coil 400 is installed over the circuit board 300 at a predetermined distance from the circuit board 300 by, for example, being bonded to a casing located above the circuit board 300. When the circuit board 300 and the antenna coil 400 have a predetermined gap therebetween in this manner, the antenna coil 400 does not come into contact with the circuit board 300, and does not influence the performance of the circuit formed on the circuit board 300. Moreover, flexibility in the layout of the antenna coil 400 can be improved since the antenna coil 400 does not come into contact with the circuit board 300.

The antenna coil 400 includes a first magnetic core 401*a* and a second magnetic core 401*b*. As shown in FIG. 14, an electrode 408 is formed so as to cover surfaces of the first magnetic core 401*a* and the second magnetic core 401*b* facing the circuit board 300. In order to avoid connection of the electrode 408 to a first coil portion 402*a* and a second coil portion 402*b*, the electrode 408 is formed on the surfaces of the first magnetic core 401*a* and the second magnetic core 401*b* facing the circuit board 300 after a nonconductive adhesive or the like is applied to the surfaces. The electrode 408 formed on the surfaces of the first magnetic core 401*a* and the second magnetic core 401*b* facing the circuit board 300 in this manner can prevent the magnetic flux that enters the first magnetic core 401*a* and the second magnetic core 401*b* from leaking into the gap between the antenna coil 400 and the circuit board 300. Thus, reduction in communication sensitivity can be regulated even when a predetermined gap is formed between the circuit board 300 and the magnetic cores 401*a* and 401*b*.

Fifth Embodiment

A portable electronic device according to a fifth embodiment will now be described with reference to FIG. 15.

Figure 15:
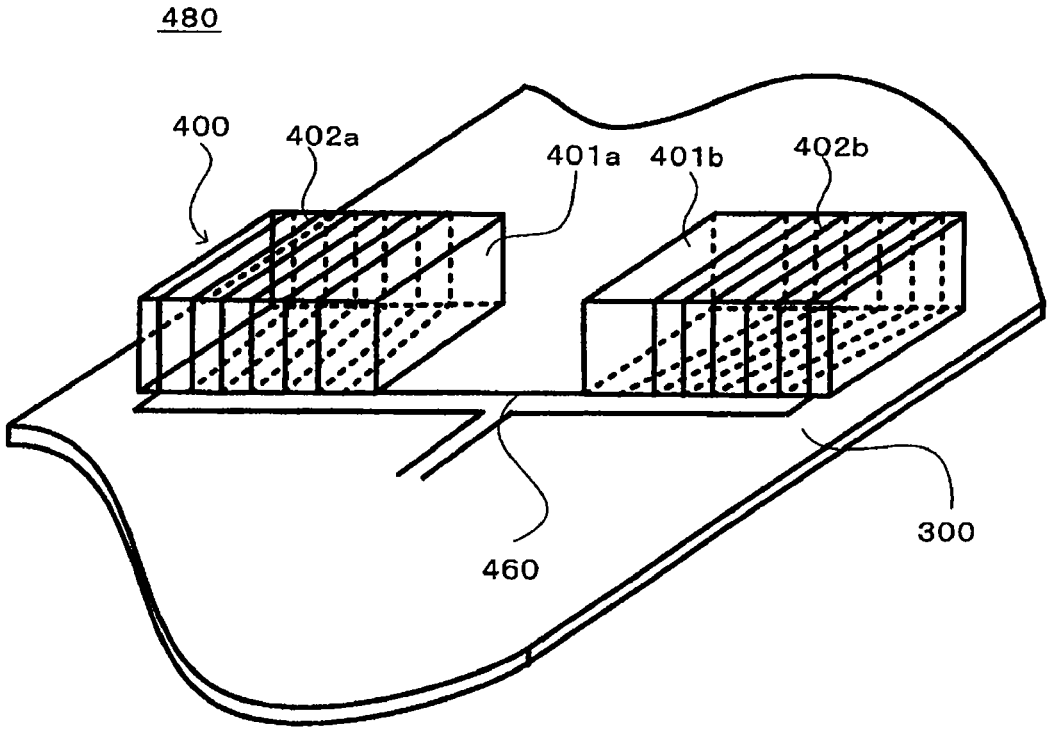
FIG. 15 is a perspective view illustrating the principal part of a portable electronic device according to a fifth embodiment.

FIG. 15 is a partially enlarged view of the portable electronic device according to the fifth embodiment. In FIG. 15, descriptions of components common to or corresponding to those shown in FIG. 13 illustrating the third embodiment will be omitted as appropriate.

As shown in FIG. 15, a portable electronic device 480 according to the fifth embodiment includes a first coil portion 402*a* and a second coil portion 402*b* connected using a connecting conductor 460 formed on a circuit board 300. The first coil portion 402*a* and the second coil portion 402*b* can be connected by only mounting an antenna coil 400 on the circuit board 300 due to the connecting conductor 460 formed on the circuit board 300. This can facilitate the production of the portable electronic device 480. The connecting conductor 460 can be formed on a circuit board other than the circuit board 300 on which the antenna coil 400 is mounted.

Figure 16:
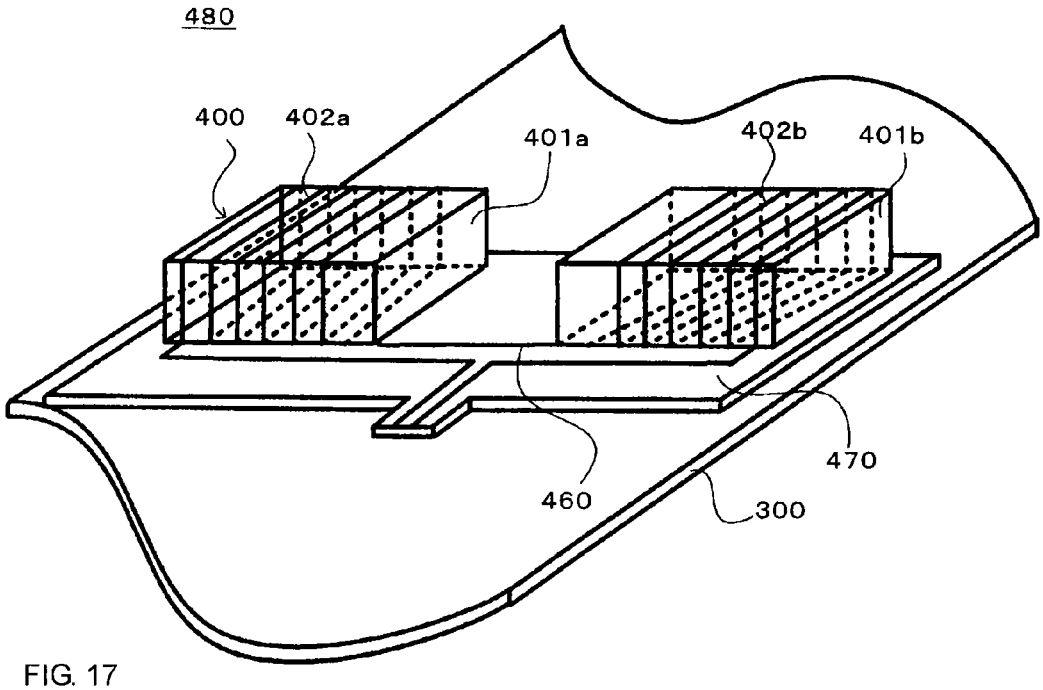
FIG. 16 is a perspective view illustrating a modification of the portable electronic device according to the fifth embodiment.
Figure 17:
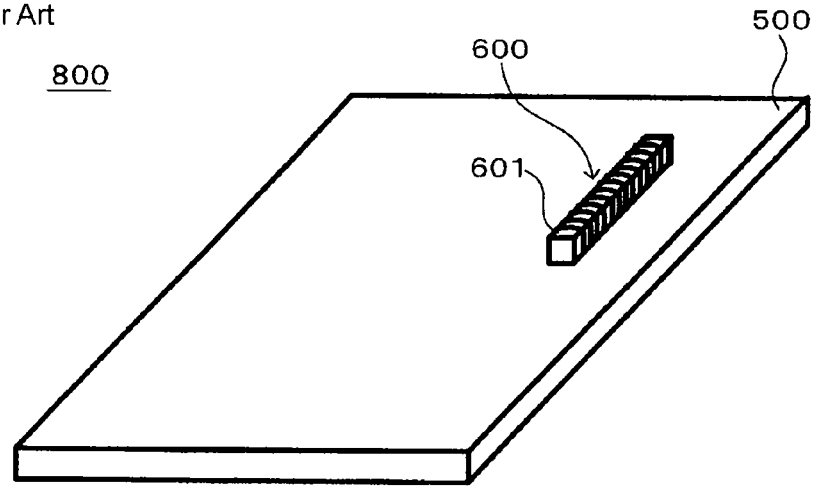
FIG. 17 Prior Art
FIG. 17 is a perspective view illustrating the principal part of a portable electronic device according to a known technology.
Figure 18:
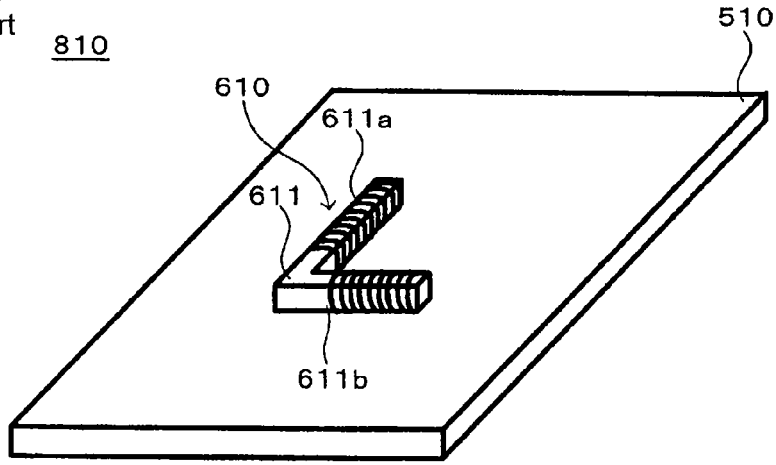
FIG. 18 Prior Art
FIG. 18 a perspective view illustrating the principal part of a portable electronic device according to another known technology.
Figure 19:
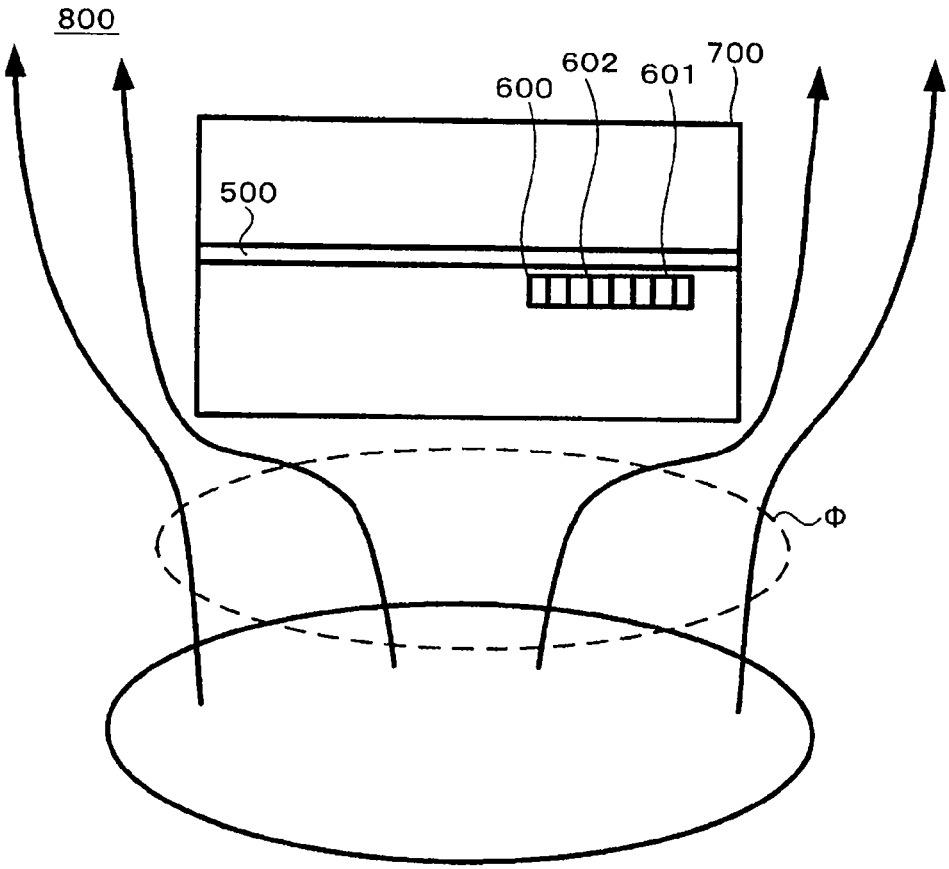
FIG. 19 Prior Art
FIG. 19 is a sectional view illustrating an example of magnetic-flux paths when the portable electronic device according to the known technology is held over a RFID reader/writer.

FIG. 16 illustrates a modification of the portable electronic device 480 according to the fifth embodiment. As shown in FIG. 16, the first coil portion 402*a* and the second coil portion 402*b* can be connected to each other using the connecting conductor 460 formed on a flexible substrate 470. The flexible substrate 470 can be formed of a foldable electrically insulating film such as a resin film including a polyimide film and a glass epoxy film. The connecting conductor 460 for connecting the first coil portion 402*a* and the second coil portion 402*b* is formed on the flexible substrate 470. Moreover, a connecting conductor for connection to an input terminal and a connecting conductor for connection to an output terminal are also formed on the flexible substrate 470. The coil portions 402*a* and 402*b* can be easily connected to the input/output terminals by only connecting the flexible substrate 470 to the input/output terminals due to the connecting conductors for connection to the input terminal and the output terminal formed on the flexible substrate 470. A first magnetic core 401*a* around which the first coil portion 402*a* is wound and a second magnetic core 401*b* around which the second coil portion 402*b* is wound are bonded to the flexible substrate 470 using an adhesive, and the first coil portion 402*a* and the second coil portion 402*b* are soldered to the connecting conductor 460. In this manner, the first coil portion 402*a* and the second coil portion 402*b* are connected to each other via the connecting conductor 460. With this structure, even when the antenna coil 400 is formed of two magnetic cores, i.e., the first magnetic core 401*a* and the second magnetic core 401*b*, the first magnetic core 401*a* and the second magnetic core 401*b* are integrated with each other on the flexible substrate 470 by bonding the first magnetic core 401*a* and second magnetic core 401*b* to the flexible substrate 470, and can be easily mounted on the circuit board 300. Moreover, when the first magnetic core 401*a* and the second magnetic core 401*b* are integrated with each other on the flexible substrate 470 in advance, there is no need to adjust the distance between the first magnetic core 401*a* and the second magnetic core 401*b* on the circuit board 300. In other words, the sensitivity of the antenna coil 400 is not changed due to the fixed distance between the first magnetic core 401*a* and the second magnetic core 401*b*.

End portions of the connecting conductor 460 formed on the flexible substrate 470 can have certain widths. When the end portions of the connecting conductor 460 have certain widths, connecting positions at which the connecting conductor 460 is connected to the first coil portion 402*a* and the second coil portion 402*b* can be arbitrarily selected within the widths of end portions of the connecting conductor 460. With this, the distance between the first magnetic core 401*a* and the second magnetic core 401*b* can be easily adjusted on the flexible substrate 470.

The invention claimed is:

1. A portable electronic device comprising:

a rectangular circuit board having a longitudinal dimension and a lateral dimension, the longitudinal dimension being larger than the lateral dimension; and an antenna coil provided on the circuit board, the antenna coil including:

a rod-shaped magnetic core, and a coil wound around the magnetic core, the coil including a first coil portion, a second coil portion, and an unwound portion at an intermediate portion of the magnetic core in a longitudinal direction thereof, wherein winding directions of the first coil portion and the second coil portion differ from each other, and wherein a length X of the magnetic core and a distance Y between two points at which a virtual line formed by projecting a central line of the magnetic core in an axial direction thereof onto the circuit board intersects an outer periphery of the circuit board along the lateral dimension thereof, satisfies $Y \geqq X \geqq 0.8Y$.

2. The portable electronic device according to claim 1, wherein a distance D1 between points x1 and y1 is equal to a distance D2 between points x2 and y2, where two intersecting points at which the virtual line intersects end surfaces of the magnetic core are defined as x1 and x2, a first of the two intersecting points at which the virtual line intersects the outer periphery of the circuit board proximal to the point x1 is defined as y1, and a second of the two intersecting points at which the virtual line intersects the outer periphery of the circuit board proximal to the point x2 is defined as y2.

3. The portable electronic device according to claim 1, wherein an electrode is provided on at least one surface of the magnetic core at the unwound portion.

4. The portable electronic device according to claim 3, wherein the electrode has at least one slit.

5. The portable electronic device according to claim 1, wherein the magnetic core has a raised portion projecting in a thickness direction of the magnetic core at the unwound portion.

6. The portable electronic device according to claim 5, wherein a second coil is wound around an outer periphery of the raised portion.

7. The portable electronic device according to claim 1, wherein the magnetic core has at least one cut-off portion at the unwound portion.

8. The portable electronic device according to claim 7, wherein the cut-off portion is provided in a surface of the magnetic core facing the circuit board.

9. The portable electronic device according to claim 7, wherein the cut-off portion is formed on a side surface of the magnetic core perpendicular to the circuit board.

10. The portable electronic device according claim 1, wherein a number of turns of the first coil portion and a number of turns of the second coil portion differ from each other.

11. The portable electronic device according claim 1, wherein the antenna coil is positioned over the circuit board so as to be separated from the circuit board by a distance, and an electrode is formed on a surface of the magnetic core facing the circuit board.

12. The portable electronic device according claim 1, wherein the rod-shaped magnetic core has a rectangular parallelepiped shape.

* * * * *